United States Patent [19]

Fievet et al.

[11] Patent Number: 4,979,377

[45] Date of Patent: Dec. 25, 1990

[54] CHAMBER WITH AN AIR HUMIDIFICATION DEVICE

[75] Inventors: Hughes Fievet, Ennevelin; Georges Vennin, Lesquin, both of France

[73] Assignee: Societe D'Electromenager Du Nord Selnor, Lesquin, France

[21] Appl. No.: 326,605

[22] Filed: Mar. 21, 1989

[30] Foreign Application Priority Data

Mar. 25, 1988 [FR] France ..... 88 03955

[51] Int. Cl.[5] ..... F25D 23/06

[52] U.S. Cl. ..... 62/274; 62/288

[58] Field of Search ..... 62/272, 274, 277, 279, 62/285, 288, 289, 286, 91

[56] References Cited

U.S. PATENT DOCUMENTS

| | | | |
|---|---|---|---|
| 2,085,346 | 6/1937 | Vretman | 62/274 |
| 2,089,960 | 8/1937 | Hull et al. | 62/91 X |
| 2,090,416 | 8/1937 | Hull | 62/274 X |
| 3,585,811 | 6/1971 | Friedel | 62/274 X |
| 3,667,249 | 6/1972 | Brown et al. | 62/91 X |
| 4,135,370 | 1/1979 | Hosoda et al. | 62/274 |
| 4,272,969 | 6/1981 | Schwitzgebel | 62/91 X |

FOREIGN PATENT DOCUMENTS

| | | |
|---|---|---|
| 3541334 | 5/1987 | Fed. Rep. of Germany . |
| 2433319 | 3/1980 | France . |

*Primary Examiner*—Lloyd L. King

*Attorney, Agent, or Firm*—Roland Plottel

[57] ABSTRACT

A chamber comprising an air humidification device is disclosed. This chamber comprises an improved humidification device. The chamber has a vessel containing water which gets evaporated to humidify the water of the chamber. When a refrigerated chamber is used, the water vapor gets condensed and solidifies in forming frost on an evaporator. Advantageously, the defrosting water is used to re-humidify the air of the chamber in making this water follow a path comprising projecting features and negative slopes. The non-evaporated defrosting water is either added to the tank or rejected outwards. The disclosed device can be applied chiefly to the humidification of chambers. It can be applied notably, to the humidification of refrigerated chambers such as, for example, chambers designed for the storage, keeping and aging of bottled wine. It can also be applied to refrigerated chambers for the storage of foodstuffs or photosensitive materials such as, for example, photographic films or photosensitive paper.

6 Claims, 2 Drawing Sheets

CHAMBER WITH AN AIR HUMIDIFICATION DEVICE

BACKGROUND OF THE INVENTION

The invention relates chiefly to a chamber with an air humidification device.

The preservation of various products as well as the proper working of an apparatus requires a degree of hydometry to be maintained. Maintaining the desired hydrometry may make it necessary either to reduce the quantity of water vapor present in the air by cooling or desiccation or, as in the present invention, to humidify air.

In the device according to the present invention, evaporation is favored by maximizing the exchange surfaces and effecting a trickling of water in the chamber to be humidified. The device according to the present invention can be applied to any closed chamber, notably to chambers for the preservation of products, as well as to dwellings. The invention can be applied particularly to refrigerated chambers. Among refrigerated chambers, chambers designed to keep bottled wine, for example, require a very high rate of humidity. This high rate of humidity enables, in particular, the wine to be isolated from external influences by causing the cork to swell up. Chambers of this type, marketed as "wine cellars", keep a constant temperature in the vicinity of 12° enabling the wine to age well.

In the device according to the invention, water is advantageously placed in a vessel at the bottom of the chamber. This device enables evaporation and facilitates the levelling of the tank. In closed, refrigerated chambers, water tends to get condensed, in forming frost on the evaporator and/or expander. During defrosting, for example by the use of a heating resistor, the frost goes into liquid phase. The device according to the present invention has guiding means enabling the water to trickle and thus promoting its evaporation.

Advantageously, the guiding device has projecting portions and regions with negative inclination favoring evaporation through an increase in the exchange surface, through the formation of cascades and/or the modification of the flow.

Thus, in a refrigerated chamber, the dehydration, caused by the presence of the cold element consisting of the expander, is compensated for.

A main object of the invention is a chamber such as the one described in claims 1 to 10.

BRIEF DESCRIPTION OF THE DRAWINGS

The invention will be better understood from the following description and the appended Figures, given as non-restrictive examples, of which:

In FIGS. 1 and 2, the same references are repeated to designate the same elements.

DESCRIPTION OF PREFERRED EMBODIMENTS

Figure 1:
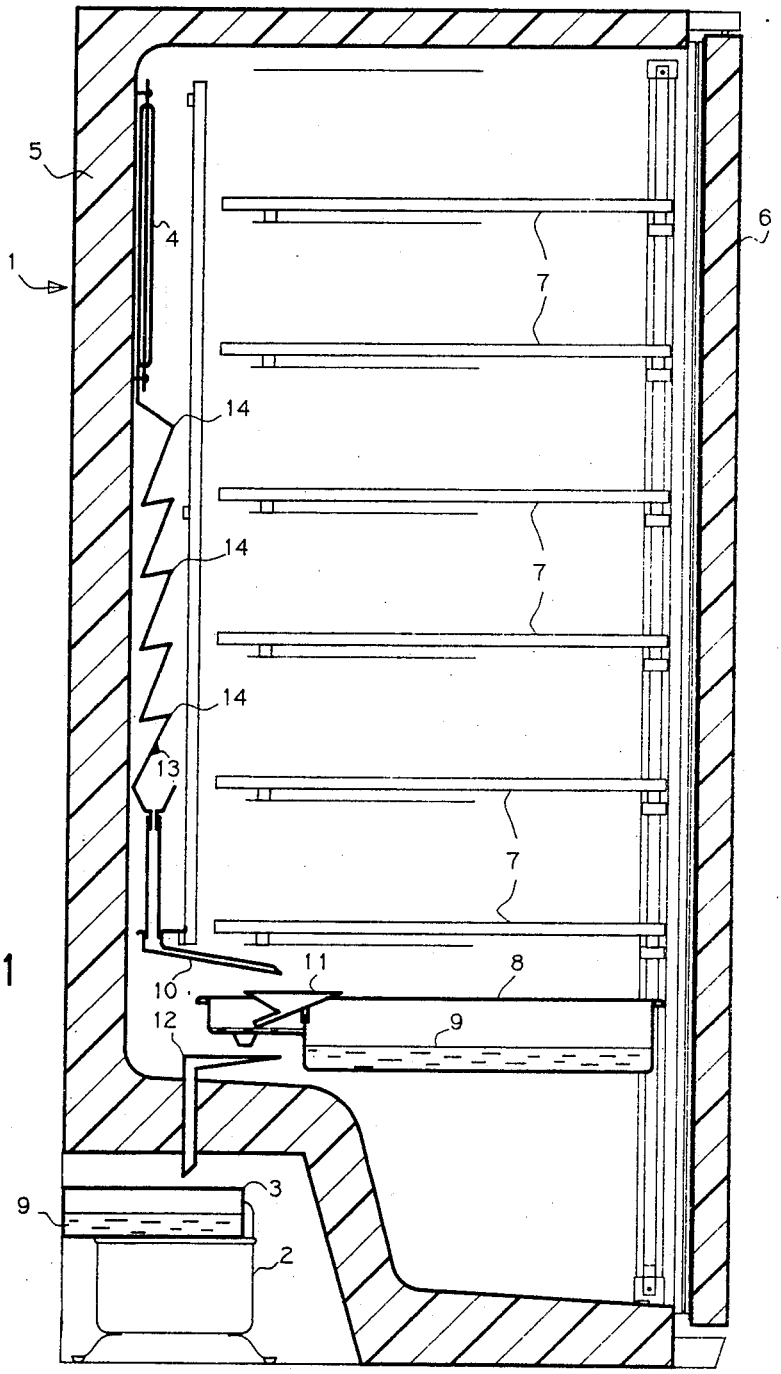
FIG. 1 shows a sectional view of a first exemplary embodiment of the device according to the present invention.

FIG. 1 shows a closed chamber 1 according to the present invention. In the exemplary embodiment shown in FIG. 1, the chamber 1 is a refrigerated chamber. It has walls 5 providing for heat insulation, a compressor 2 and an evaporator/expander 4. The hermetically sealed circuits, connecting the compressor 2 to the evaporator 4 and possibly including a heat exchanger on their return path, are not shown in the FIG. 1. A door 6 provides access to the inside of the chamber 1. The refrigerated chamber 1 is, for example, a refrigerator or, as shown in FIG. 1, a "wine cellar" designed for the keeping and aging of bottles of wine. The chamber of FIG. 1 has supports 7 designed to take bottles enabling their storage in horizontal position. Advantageously, the door 6 is transparent to enable visual checking of the stored bottles. Advantageously, the door 6 filters rays that are harmful to wine.

One of the original features of the device according to the present invention consists in the presence of a vessel 8 of water 9 placed in the lower part of the chamber 1. This vessel is designed to maintain high hydrometry needed, for example, for the strength of the corks which ensure that the bottles are hermetically closed, or needed for the preservation of vegetables and, notably, green salads in refrigerators.

The position of the water vessel makes it possible to improve the humidification of the chamber 1 because it corresponds to the place where the temperature in the chamber is at its highest inasmuch as it is at a distance from the evaporator 4. However, the fact of placing the vessel 8 or an additional vessel in the median or upper part of the chamber 1 does not go beyond the scope of the present invention.

Unfortunately, the humidity gets condensed to form frost on the evaporator 4. This phenomenon, firstly, disturbs the efficient working of the evaporator 4 in reducing heat exchanges between the air of the chamber 1 and the evaporator 4 and, secondly, reduces the humidity of the air in the chamber 1. For the efficient working of the refrigerated chamber 1, a defrosting of the evaporator 4 is done. This defrosting is advantageously automatic. For example, the frost deposited on the evaporator 4 is made to melt by stopping the compressor 2 and delivering an electrical current in a resistor (not shown in FIG. 1) which is solidly joined to the evaporator. The defrosting operation, which is known per se, supplies water in liquid form. In a standard type of refrigerated chamber, the defrosting water is discharged to the outside of the chamber 1. In the device according to the present invention, the defrosting water is used to humidify the air of the chamber 1. To do so, water guiding means 13 have been connected to the evaporator 4. Advantageously, the water guiding means 13 comprise projecting features 14 and regions with a negative slope. Thus, the trickling surface is increased and small waterfalls are created, favoring the evaporation. The mini-waterfalls enable water to be evaporated on both faces of the flow. Moreover, evaporation is favored by the fact that the water goes into a state of turbulent flow.

In the exemplary embodiment of the device according to the present invention, shown in FIG. 1, the water that has not evaporated during its path along the guiding means 13 is discharged to the exterior, for example by a conduit 10 leading to a first funnel 11, filling a transfer tank which flows over through a second funnel 12 into an external reserve 3. Advantageously, the tank 3 is heated to enable the evaporation of the water with a view to its removal. Thus, no maintenance is needed to empty the tank 3. Advantageously, the tank 3 is placed on the compressor 2, so as to take advantage of the calories coming from the working of the compressor 2. Furthermore, the tank 3 increases the efficiency of the device in providing for the cooling of the compressor 3. The discharging of the water 9 towards the outside of the chamber 1, for example towards the tank 3, enables clean water to be added to the tank 8, and thus provides the assurance of limiting the formation of micro-organisms in the tank 1.

Figure 2:
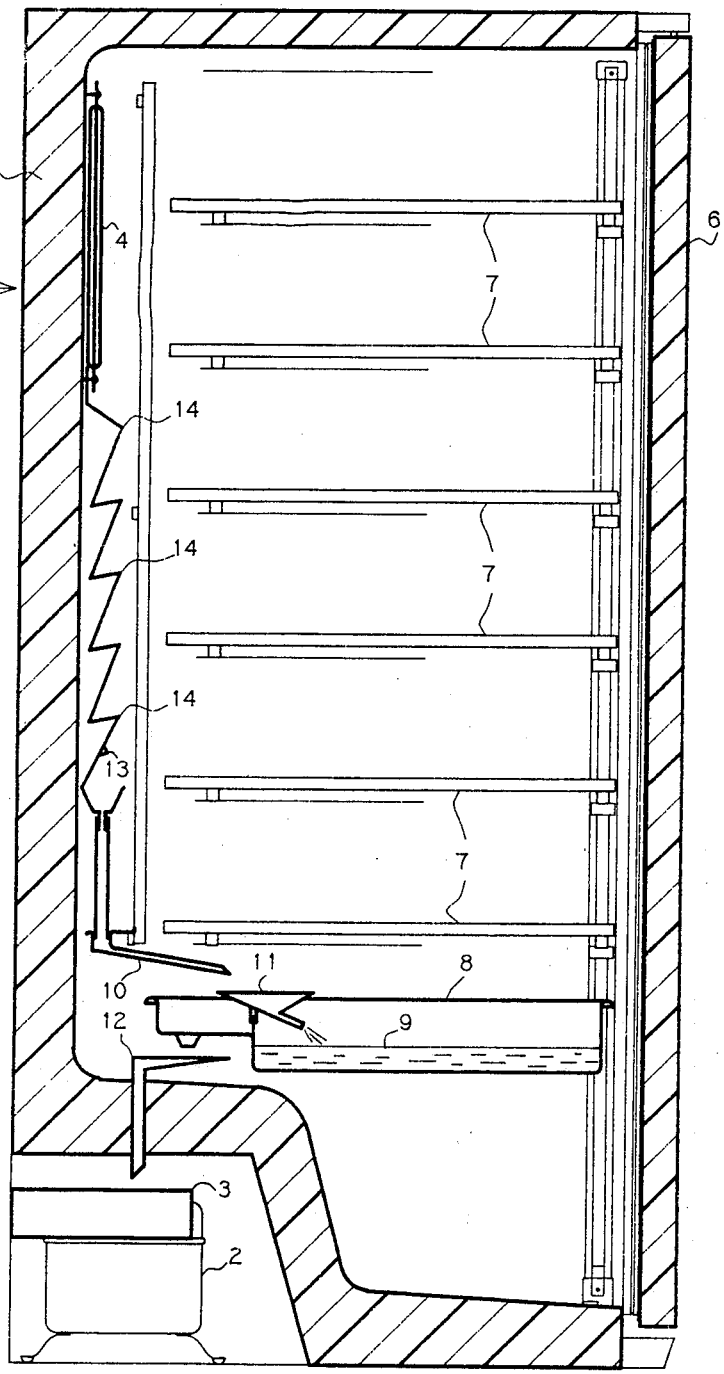
FIG. 2 shows a sectional view of a second exemplary embodiment of the device according to the present invention.

However, the device of FIG. 1 necessitates the periodic addition of water 9 into the tank 8. This may prove to be a constraint if for example, the device of FIG. 1 has not been under supervision for a long time. In a case such as this, it may be advantageous, as shown in FIG. 2, to add water which has not evaporated in its path on the guiding means 13 in the tank 8. In this case, the funnel 11 opens out into the tank 8.

As can be seen, these two embodiments have drawbacks. Advantageously, the funnel 8 can rotate on its axis to enable, depending on the selected position, the closed circuit operation shown in FIG. 2 or an operation with discharge, towards an external tank 3, of the non-evaporated defrosting water as shown in FIG. 1. The direct connection of the guiding means 3 to the tank 8 or to the tank 3, for example by a pipe, does not go beyond the scope of the present invention. This pipe is either fixed to provide for the desired mode from among the two modes of operation, or it may be placed in the desired position in the tank 8 or the tank 3.

The evaporation of the defrosting water further has the advantage of cooling the chamber 1. The use of the latent, vaporizing heat of the defrosting water or of the water 9 contained in the vessel 8 enables energy savings.

The invention applies chiefly to the humidification of chambers. The invention applies notably to the humidification of refrigerated chambers such as, for example, chambers designed for the storage, keeping and aging of bottled wine. The invention can be applied also to refrigerated chambers for the storage of foodstuffs or of photosensitive materials such as, for example, photographic films or photosensitive paper.

What is claimed is:

1. A refrigerated chamber having a cooling system and means for humidification, said means for humidification comprising at least one water vessel (8) at a place where the temperature in the chamber favors the evaporation of its water, an evaporator (4) of said cooling system condensing the evaporated water in said refrigerated chamber, means for defrosting said evaporator (4), and means (13,14) for guiding in said refrigerated chamber a flow of defrosted water from said evaporator to said water vessel (8) and creating in said flow of defrosted water mini-waterfalls which enable defrosted water to be evaporated on both faces of the turbulent flow.

2. A chamber according to claim 1, wherein the means for guiding (13, 14) the flow of defrosted water and creating in said flow of defrosted water mini waterfalls comprises projecting features and regions with a negative slope (14).

3. A chamber according to claim 1, comprising supports (7) designed to take bottles of wine, foodstuffs or photosensitive materials.

4. A chamber according to claim 1, comprising a closed circuit of water which, after evaporating from said water vessel (8), condensing and being defrosted on the evaporator (4) of said cooling system, flowing and evaporating on said guiding and creating mini-waterfalls means (13, 14), returns to said water vessel (8).

5. A chamber according to claim 1, wherein said means for humidification comprises selection means (11) which depend on the setting made, for conveying defrosted water from the guiding and creating mini-waterfalls (13, 14) means towards the exterior (3) or towards said water vessel (8).

6. A refrigerator providing cooling and humidity comprising, a refrigerator chamber (1,6), tank means (8) for holding water and which water evaporates into said chamber, evaporator means (4) within said refrigerator chamber at an upper portion thereof for cooling the air and also condensing evaporated water within said chamber and for subsequently melting the frost formed thereon, and means extending between said evaporator means and said tank means, for guiding and evaporating defrosted water (13, 14) from said evaporator means (4) to said tank means (8) and into said chamber, said guiding and evaporating means being positioned substantially vertically, and said tank means and said evaporating means consisting of substantially of all the sources of humidity and evaporation provided by said refrigerator.

* * * * *